US005791008A

United States Patent [19]

Crabtree

[11] Patent Number: 5,791,008

[45] Date of Patent: Aug. 11, 1998

[54] SPONGE INCORPORATING HAND GRASP

[76] Inventor: Marianne E. Crabtree, 3845 Rugen Rd., Glenview, Ill. 60025

[21] Appl. No.: 835,068

[22] Filed: Apr. 4, 1997

[51] Int. Cl.[6] ..... A47K 7/04; A47L 17/08

[52] U.S. Cl. ..... 15/244.1; 15/209.1; 15/244.4

[58] Field of Search ..... 15/209.1, 229.14, 15/244.1, 244.2, 244.3, 244.4

[56] References Cited

U.S. PATENT DOCUMENTS

| | | | |
|---|---|---|---|
| 723,462 | 3/1903 | Hart . | |
| 1,006,741 | 10/1911 | Ferry . | |
| 1,723,520 | 8/1929 | Pintel . | |
| 2,390,921 | 12/1945 | Clark . | |
| 2,637,871 | 5/1953 | Moser . | |
| 3,142,855 | 8/1964 | Gilchrist | 15/244.1 |
| 3,389,418 | 6/1968 | Sencabaugh . | |
| 3,568,237 | 3/1971 | Rhodes . | |
| 3,570,036 | 3/1971 | Gilchrist | 15/244.1 |
| 3,704,480 | 12/1972 | Whitaker . | |
| 4,475,836 | 10/1984 | Colognori . | |
| 4,615,066 | 10/1986 | Colognori . | |
| 5,003,659 | 4/1991 | Paepke | 15/244.1 |

FOREIGN PATENT DOCUMENTS

| | | | |
|---|---|---|---|
| 1434159 | 2/1966 | France | 15/244.1 |
| 1029136 | 4/1958 | Germany | 15/244.1 |

OTHER PUBLICATIONS

"Household Hints & Tips" 1996 by Casssandra Kent DK Publishing, Ltd.

*Primary Examiner*—Terrence Till

[57] ABSTRACT

The sponge incorporates a sponge block and a hand grasp which may either be an integral part of the sponge block or may be a separate member fixed to the sponge block in a predefined manner. The grasp is configured to resemble a butterfly winged element, flexible about a center area thereof which is fixed to a surface of the sponge block opposite a contact surface of the sponge block.

16 Claims, 4 Drawing Sheets

SPONGE INCORPORATING HAND GRASP

BACKGROUND OF THE INVENTION

Heretofore, a secure and comfortable grasp of a sponge has been difficult. Often a sponge becomes deformed around a midsection as the user squeezes a sponge in the hand inorder to restrain the sponge during use. Such deformities often cause a sponge's contact surface to crease in multiple areas awhile the edges of the sponge tends to arc toward the user's hand. The result is an uneven and distorted contact surface negating the smooth flow and even application of substances being used on the sponge. Also, many sponges tend to become slippery when wet making a secure hold of a sponge even more difficult. In addition, even holding a smaller sized sponge by wrapping the hand around the surfaces, but not squeezing, often causes the thumb or fingertips to engage in direct contact with oftentimes abrasive surfaces which can result in broken fingernails, irritated skin and injury. Even if protective gloves are used, the abrasive underlying surface often cuts the glove tips resulting in damaged fingernails.

Existing art attempting to solve the foregoing problems associated with sponges, even include sponges being provided with finger grooves or offered in undulated configurations. However, such variations offer minimal added graspability, often still requiring the user to squeeze the sponge's midsection thereby creating the same problems as above.

Other art offers a sponge either permanently glued to an impervious plate having a molded plastic handle or knob on surface, or a sponge having been restrained within a molded 0 ring aperture or other device. However, such "one size fits all" rigid devices are difficult to hold in the hand and can be especially uncomfortable for persons with small hands or with persons having medical conditions such as arthritis.

Additionally, other known art described as "sponges", which are made from gathered material such as netting or mesh, are often provided with an attached loop element made from similar material that encircles the hand as a means to restrain the "sponge" during use. However, such attachments often stretch out thereby rendering such attachments useless.

Other known art provides a graspable element in the general shape of a knob, usually fashioned from one block of sponge-like material and positioned on the opposite side of the sponge's contact side. However, regardless of the overall size, shape or configuration of such embodiments, the user still has to squeeze such knobs in their general midsection inorder to grasp the embodiment. This squeezing action, of an often bulky foam knob, often will result in the sponge section having the contact surface to arc upwards thereby contorting the sponge block and the contact surface, rendering the article less efficacious as to its intended purpose.

Other known art provides a projection, as an intregal part of an applicator device, as a means to manually grasp the article in such a manner as to not have the hand come in direct contact with the application surface. However, such art does not provide a means of vertical leverage to apply a substance evenly and completely, as the user is grasping the projected element on the same plane as the article's contact surface, which causes the surface closest to the projected element to arc upward thereby causing particular substances to "lump up" near the graspable element, much like a trowel used for spreading cement.

SUMMARY OF THE INVENTION

The sponge with hand grasp of the present invention obviates the problems described above by providing a hand grasp, either as an integral part of the sponge, or as a separate member, the hand grasp in the preferred embodiment being a compressible butterfly wing forming pad-like grasp along a surface of the sponge opposite a contact surface thereof.

BRIEF DESCRIPTION OF THE DRAWINGS

According features of my invention, I have provided a sponge block, the sponge block having a first contact surface and incorporating a grasp on a second surface of the sponge block which is opposite the first contact surface thereof, the grasp comprises a butterfly wing forming pad, the pad engages the sponge block in a substantially centered area of the pad, the grasp includes a hanger port therein.

According to yet other features of my invention I have provided a sponge comprising a sponge block, the sponge block having a first contact surface and incorporating a grasp on a second surface of the sponge block which is opposite the first contact surface thereof, the grasp comprises a butterfly wing forming pad, the pad engages the sponge block in a substantially centered area of the pad, butterfly wing forming pad has wing portions fixed to the sponge block at inner ends and with the wing portions being flexibly movable and manually liftable away from the sponge block at outer ends thereof, the wing portions each having rounded edges which when the wing portions are upwardly moved, the rounded edges can nestingly engage in a palm of a persons hand or in a crook of fingers on a hand.

Figure 1:
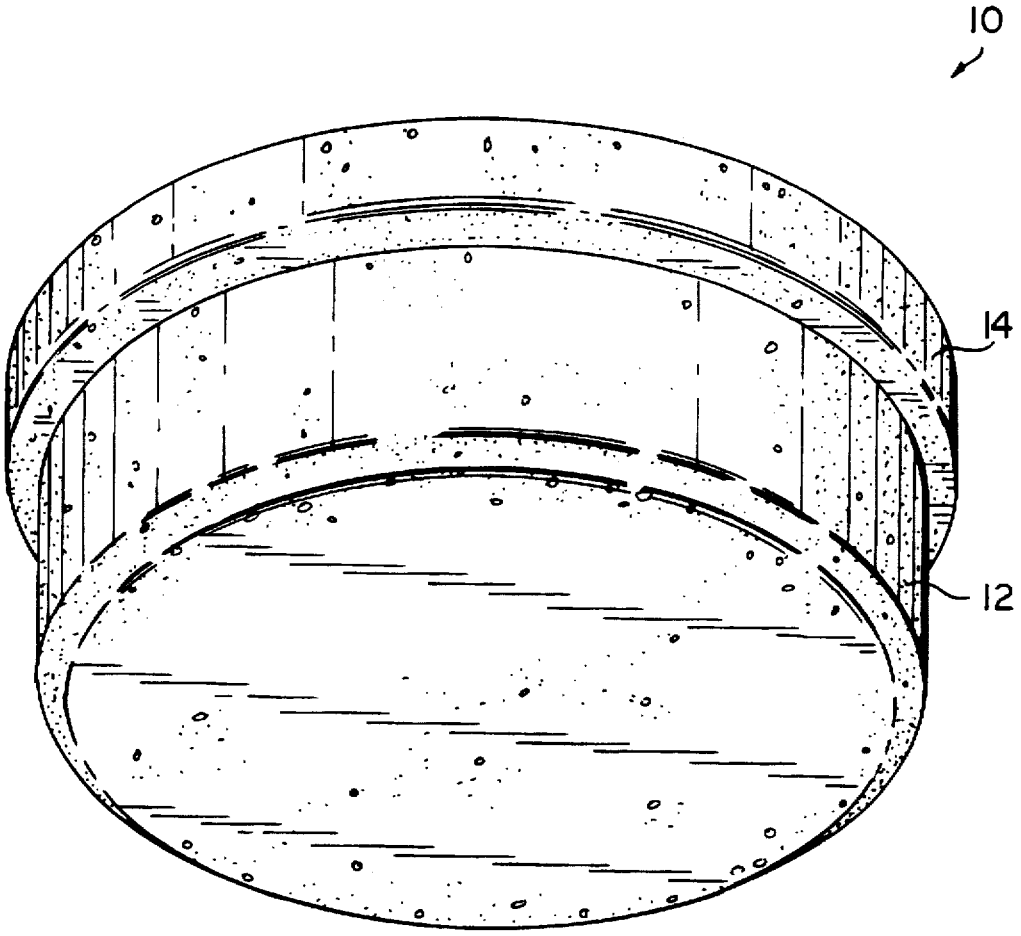

Other objects and advantages of the invention will become more apparent upon perusal of the detailed description thereof and upon inspection of the drawings in which:

FIG. 1 is a perspective view of the sponge incorporating a hand grasp made in accordance with the teachings of the present invention.

Figure 2:
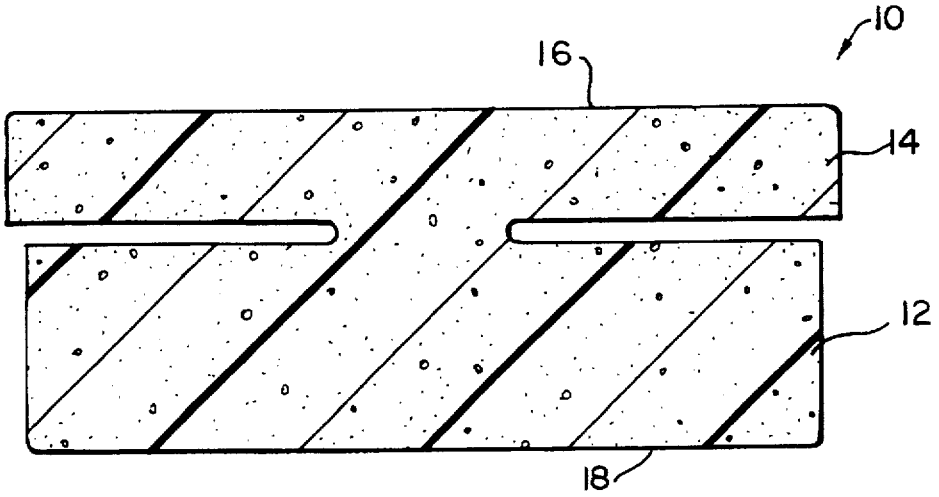

FIG. 2 is a radial cross section through the sponge showing the grasp as an integral section of the sponge.

Figure 3:
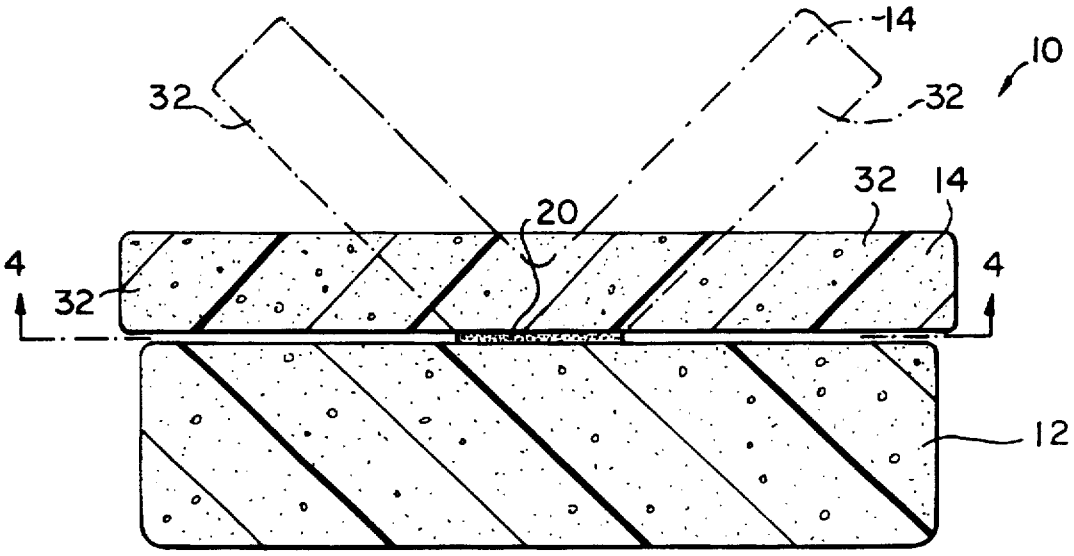

FIG. 3 is similar to FIG. 2, but showing the grasp as a separate member and showing flexion of the grasp in phantom.

Figure 4:
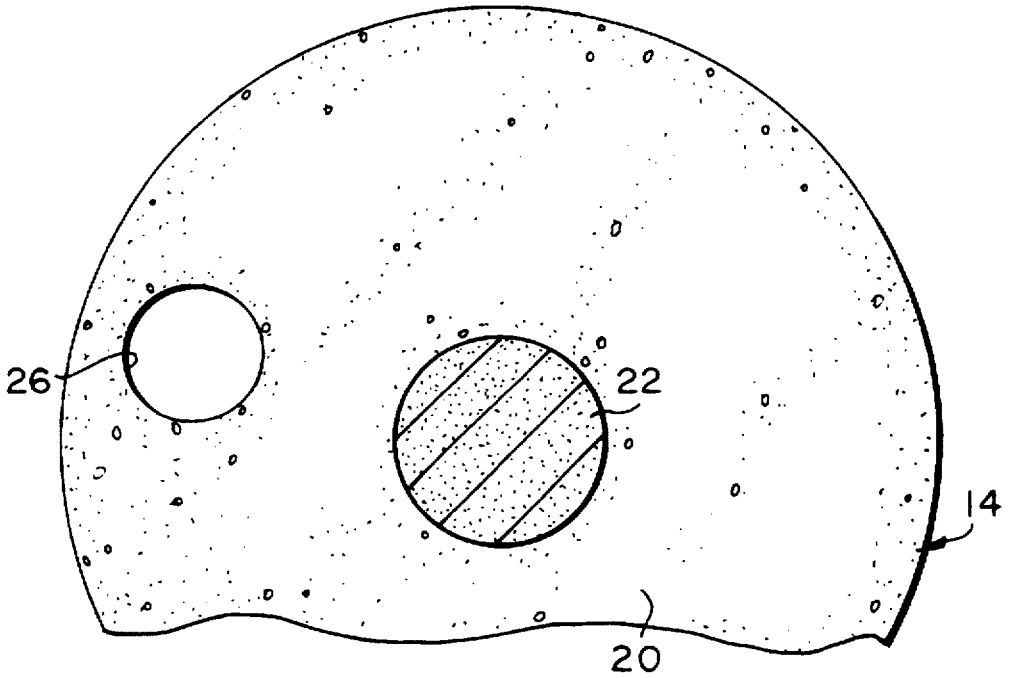

FIG. 4 is a bottom plan view of a separate grasp member showing a first configuration for an area of engagement between the grasp and a sponge to be used therewith, and showing a hanger port in the grasp.

Figure 5:
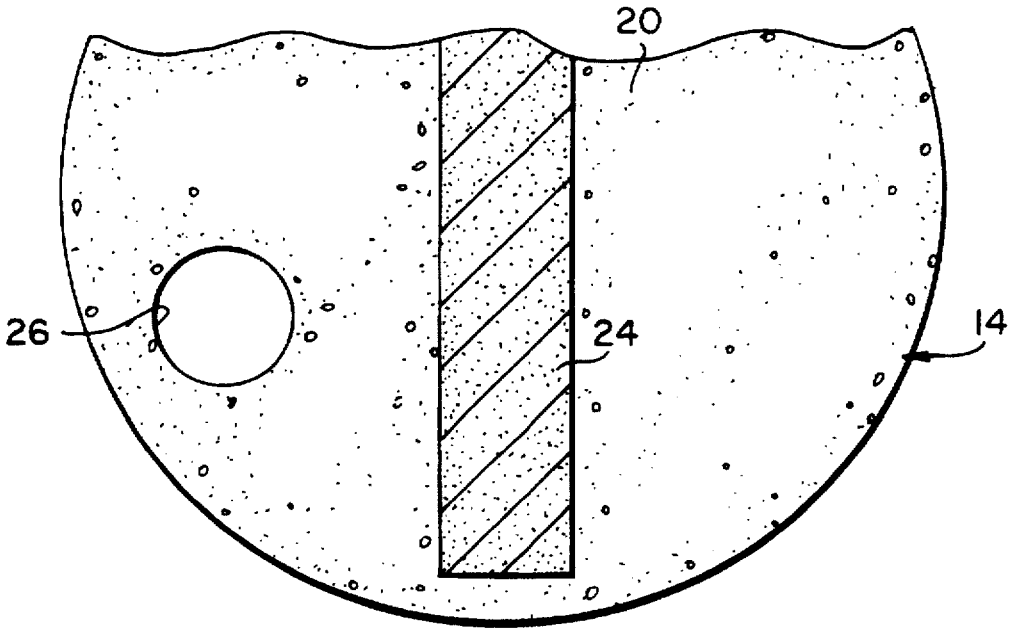

FIG. 5 is similar to FIG. 4 but showing a second configuration for the area of engagement.

Figure 6:
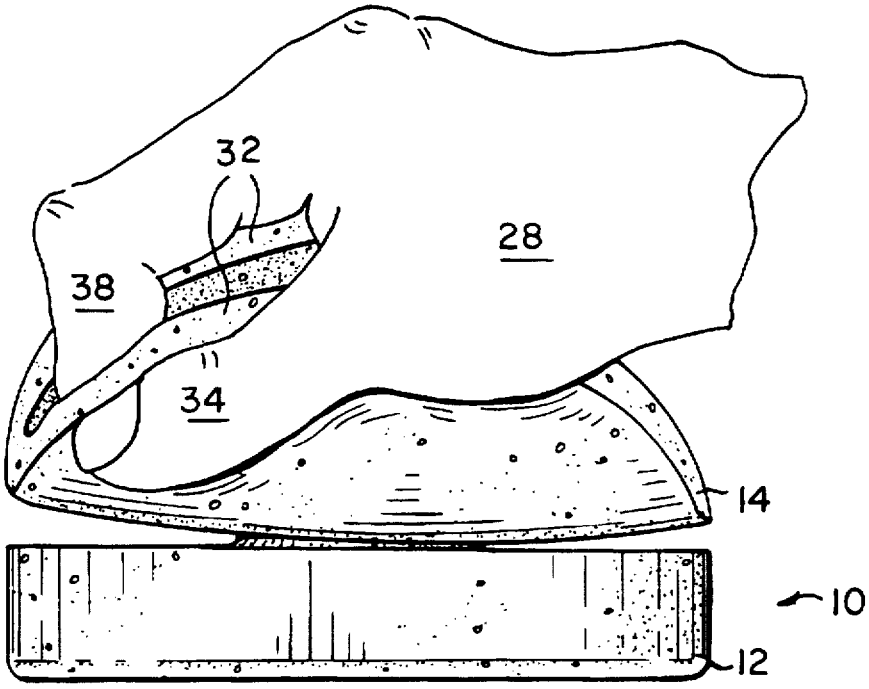

FIG. 6 shows a sponge having the grasp engaged by a hand.

Figure 7:
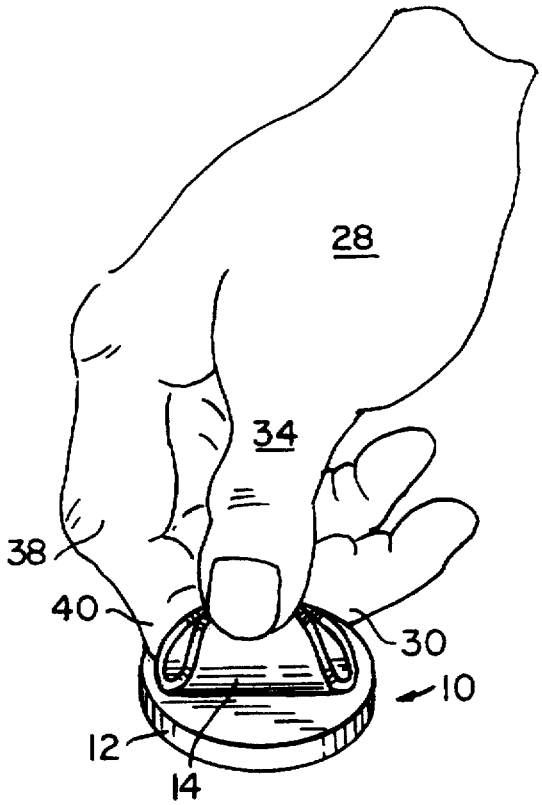

FIG. 7 shows a smaller version of the sponge of FIG. 6 showing the grasp engaged by fingers.

DESCRIPTION OF THE PREFERRED EMBODIMENTS

Referring now to the drawings in greater detail there is illustrated therein the sponge incorporating a hand grasp made in accordance with the teaching of the present invention and generally identified by the reference numeral 10.

As shown, the sponge 10 includes a first bottom section 12 which comprises an absorbent block 12 and a second top section 14 which comprises a contiguous, flexible, compressible, pad-like grasp 14 for the absorbent block 12. Although the block 12 and grasp 14 are shown to be of a rounded configuration, this is not to be construed as limiting. In FIG. 2, the grasp 14 is shown in a preferred embodiment, wherein a diameter 16 thereof is slightly greater than a diameter 18 of the block 12, such greater diameter 16 accommodating separation and graspability of the grasp 14, relative to the underlying block 12.

It will be understood that the grasp 14 may be created integrally with the block 12, as shown in FIG. 2, or may be created as a separate pad member 14 which is engageable to the block 12 as shown in FIG. 3.

FIG. 3 further illustrates in phantom, required flexibility of the grasp 14, about a substantially central area 20 thereof which forms an area 20 of attachment between the grasp and the block 12.

Turning to FIGS. 4 and 5, two preferred configurations for the central area 20 of attachment for the grasp 14 are defined. A first circular configuration 22 for the area 20 is shown in FIG. 4 and a centered elongate strip configuration 24 for the area 20 is shown in FIG. 5. If desired a hanger port 26 may be provided in the grasp 14 so the sponge 10 may be hung for drying.

It will be understood that any of a plurality of configurations for the area 20 would be acceptable, so long as flexion of the grasp 14 thereabout, as illustrated in FIGS. 3, 6 and 7 could be achieved. Such area 20 could be created in any known manner, such as an appropriate adhesive or other known attachment devices.

FIG. 6 shows a larger embodiment of the sponge 10 for purposes such as scrubbing or bathing wherein the grasp 14 is engageable by a hand 28, while FIG. 7 shows a smaller embodiment of the sponge 10, wherein the grasp 14 is engageable by fingertips 30, for purposes such as application of cosmetics or skin medicaments.

In use, as shown the grasp 14 is engaged along opposed circumferential areas 32 thereof, and the circumferential areas 32 are pivoted upwardly toward one another (FIG. 3) about the area of engagement 20, creating a butterfly wing configuration about the area 20, defining the grasp 14.

When grasped by the hand 28, a user places a thumb 34 along one circumferential area 32 of the pad 14 and the fingers (not shown) along the opposite, circumferential area 32 of the pad 14, bringing the thumb 34 and fingers together to engage the wing like areas 32 formed by flexing of the pad 14 about the area 20 therebetween. If pressure is to be applied by the block 12, one may insert a forefinger 38 as shown in FIG. 6, between the areas 32, and press the block 12 against a subjacent surface (not shown) with the forefinger 38, as well as with the remainder of the hand 28.

Alternatively, as shown in FIG. 7, a smaller sponge 10 is used, such as for the application of cosmetics or skin medicaments, and the areas 32 are grasped between the thumb 34 and tip 40 of the forefinger 38.

Provision of such grasp 14 for the sponge 10 provides for excellent hand engagement of the sponge 10, and even accommodates use by one having long fingernails, the fingernails never engaging against an underlying surface.

As described above, the sponge 10 of the present invention provides a number of unique advantages, some of which have been described above and others of which are inherent in the invention. Also, modifications may be proposed to the sponge 10 without departing from the teachings herein. Accordingly, the scope of the invention is only to be limited as necessitated by the accompanying claims.

I claim:

1. A sponge comprising a sponge block, said sponge block having a first contact surface and incorporating a grasp on a second surface of the sponge block which is opposite the first contact surface thereof, said grasp comprises a butterfly wing forming pad, said butterfly wing forming pad engages the sponge block in a substantially centered area of the pad, said grasp includes a hanger port therein.

2. The sponge of claim 1 wherein said grasp is an integral extension of the sponge block.

3. The sponge of claim 1 wherein said grasp is a separate pad fixed to said sponge block.

4. The sponge of claim 3 wherein said grasp is permanently fixed to said sponge block.

5. The sponge of claim 3 wherein said butterfly wing forming pad has wing portions fixed to said sponge block at inner ends and with said wing portions being movable and manually liftable away from the sponge block at out ends thereof.

6. The sponge of claim 1, wherein said butterfly wing forming pad has butterfly wing portions fixed to said sponge block at inner ends and with said wing portions being movable and manually liftable away from the sponge block at out ends thereof.

7. The sponge of claim 6 wherein said butterfly wing portions of said pad each being sized and arcuately shaped to fit into a crook of a hand of a person for ease of use.

8. The sponge of claim 6 wherein said butterfly wing portions of said pad being sized to provide an annular upstanding edge that is flexible and turnable into a crook of a persons fingers for ease of use.

9. A sponge comprising a sponge block, said sponge block having a first contact surface and incorporating a grasp on a second surface of the sponge block which is opposite the first contact surface thereof, said grasp comprises a butterfly wing forming pad, said pad engages the sponge block in a substantially centered area of the pad, said butterfly wing forming pad has wing portions fixed to said sponge block at inner ends and with said wing portions being flexibly movable and manually liftable away from the sponge block at outer ends thereof, the wing portions each having rounded edges which are sized to fit in a persons hand when the wing portions are upwardly moved.

10. The sponge of claim 9 wherein said grasp is an integral extension of the sponge block.

11. The sponge of claim 9 wherein said grasp is a separate,pad fixed to, said sponge block.

12. The sponge of claim 9 wherein said grasp is permanently fixed to said sponge block.

13. The sponge of claim 9 wherein said butterfly wing forming pad being comprised only of a single layer for flexibility, the pad having wing portions fixed to said sponge block at inner ends and with said wing portions being flexibly movable and manually liftable away from the sponge block at out ends thereof.

14. The sponge of claim 9 wherein said butterfly wing forming pad has butterfly wing portions fixed to said sponge block at inner ends and with said wing portions being movable and manually liftable away from the sponge block at outer ends thereof.

15. The sponge of claim 14 wherein said butterfly wing portions of said pad being movable back and forth into and out of flush, face to face engagement with said pad and with said rounded edges being concentric with an outer edge of said pad.

16. The sponge of claim 15 wherein said butterfly wing portions of said pad providing a rounded upstanding edge that is flexible and engageable with a hand of a person.

* * * * *